US007344196B2

(12) United States Patent
Rodriquez

(10) Patent No.: US 7,344,196 B2
(45) Date of Patent: Mar. 18, 2008

(54) U-SHAPED SEAT CUSHION HAVING THERMAL TRANSFER UNIT

(76) Inventor: Raul Rodriquez, 2418 Elm St., Bakersfield, CA (US) 93301

( * ) Notice: Subject to any disclaimer, the term of this patent is extended or adjusted under 35 U.S.C. 154(b) by 0 days.

(21) Appl. No.: 11/391,144

(22) Filed: Mar. 28, 2006

(65) Prior Publication Data

US 2007/0236074 A1 Oct. 11, 2007

(51) Int. Cl.
*A47C 7/02* (2006.01)

(52) U.S. Cl. ..... 297/452.41; 297/180.11; 297/180.12; 5/652.1; 5/653

(58) Field of Classification Search ..... 297/180.12, 297/452.41, 180.11; 5/652.1, 653
See application file for complete search history.

(56) References Cited

U.S. PATENT DOCUMENTS 3,940,183 A 2/1976 Seltzer et al.
4,563,785 A 1/1986 Samelson
4,660,238 A 4/1987 Jay
4,858,259 A * 8/1989 Simmons et al. ..... 5/644 X
5,344,437 A * 9/1994 Pistay ..... 607/109
5,378,045 A 1/1995 Siekman et al.
5,557,815 A 9/1996 Mintz et al.
5,702,153 A 12/1997 Pliska
6,523,202 B2 2/2003 Loomos

* cited by examiner

*Primary Examiner*—Anthony D. Barfield
(74) *Attorney, Agent, or Firm*—Richard A. Ryan

(57) ABSTRACT

A padded seating cushion having a main section at the front end and a pair of arms extending rearwardly therefrom to define a generally U-shaped aperture open and extending to the rear of the cushion to support the user's ischial portions while alleviating direct pressure on the coccyx. The arms define an inner section having inner side walls defining a thermal transfer chamber in which a thermal transfer unit is placed to selectively provide heat or cold for the user. The thermal transfer unit attaches to a lower chamber member that attaches to the arms. The thermal transfer unit comprises a thermal unit disposed in a thermal container, preferably in the form of a pouch. The cushion attaches to a seat with removably attached straps connected to ring members on each side of the cushion, providing a padded surface that does not shift with the movements of the user.

16 Claims, 3 Drawing Sheets

U-SHAPED SEAT CUSHION HAVING THERMAL TRANSFER UNIT

CROSS-REFERENCE TO RELATED APPLICATIONS

None.

BACKGROUND OF THE INVENTION

A. Field of the Invention

The field of the present invention relates generally to seating cushions used for the elimination and/or prevention of pain to the lower spine, coccyx and perineum region of the human body. More specifically, the present invention relates to such seat cushions that are configured as a U-shaped pad and which have a thermal emitting device, containing a temperature retaining material such as solid, gel or fluid-based compositions, to serve as an ice pack or heating pad to provide cooling or heat in addition to cushioning.

B. Background

As is commonly known, conventional seating for humans usually consists of a hard surface that supports the weight of the human body and a cushioning element to soften the seating surface. Cushioning of the seating surface is often achieved through the addition of a separate cushioning device or substance that attempts to alleviate the pressure on the points of the weight bearing portions of the human body, such as the ischial tuberosities as well as trochanters and the coccyx. A virtually infinite array of sizes and shapes of cushions are known to exist. Most are in the traditional "pillow" shape, being either round, square or rectangular in the major configuration and having rounded sides separated by the minor dimension of the cushion. Such cushions are primarily for decorative purposes and are not intended specifically to take into account the comfort or prevention of pain of the user. Prior art teaches that cushions constructed as seating devices are configured for the generic needs of the user and are often configured to correspond to the shape of the seating surface, such as a chair, stool or bench, and not to the anatomical needs of the user. Examples of this type of seat cushion is described in U.S. Pat. No. 4,563,785 to Samelson and U.S. Pat. No. 5,557,815 to Mintz et al.

When seating cushions are prescribed for medical conditions by clinicians or chosen by the user, often the determination of which cushion to use is based on the cushion's pressure distribution properties especially, under the ischial tuberosities and sacrum. Gel, fluid or air-based support provides a less-ridged base of support, examples of which are described in U.S. Pat. Nos. 4,660,238 to Jay and 5,378,045 to Siekman. The shape of the seating cushion also plays a significant role in determining its therapeutic or palliative properties, as exemplified by U.S. Pat. No. 6,523,202 to Loomos and U.S. Pat. No. 5,702,153 to Pliska. Concerning cushions to be used as therapeutic devices and/or devices to prevent injury or bodily stress, such cushions can be categorized by two primary types of functional needs. One type is those meant generally to be used by patients with conditions wherein sitting is either painful due to specific medical conditions, such as episiotomy sites or hemorrhoids. The other type is those meant to be used by the general public in situations that require lengthy periods of sitting, including workplace conditions, driving or by individuals confined to sitting in a wheelchair, wherein the seat cushion serves as a device to prevent injuries and discomfort to the lower spine, coccyx, and perineum region of the human body.

The physical act of sitting can be painful due to the pain associated with sheer stress combined with vertical pressure applied to the skeletal-muscular region of the spine as well as the elevated temperature and humidity in and surrounding the perineum. Thus, sitting for a long period on an unpadded surface can either exacerbate existing injuries or induce new injuries to these regions of the human body. Often, the common response for treating conditions that make sitting uncomfortable is to recommend the use of a circular-shaped or doughnut configured cushion. One problem associated with the circular doughnut shaped cushion, however, is that the cushion does not substantially eliminate pressure upon the ischia of a patient. In addition, because of the location of the aperture in the center of the doughnut cushion, the doughnut cushion is relatively difficult to use, requiring either a sense of balance and/or the ability to reposition oneself in the case of slippage. As a result, many patients who lack the physical strength or patience to reposition themselves if the cushion shifts, are often compelled or choose to forego using the doughnut shaped cushion in favor of a more stable type of cushion, often at the expense of the needed padding or cushioning. Because there is direct pressure on the ischia and surrounding anatomical region of the user when using the doughnut shaped cushion, patients who are prescribed this cushion are generally forced to manipulate the integral doughnut shape of the pillow in order to obtain relief by eliminating the direct contact and pressure on the coccyx. It is commonly known that some patients deflate the pillow in order to fold the doughnut in half, thereby creating a somewhat U-shaped cushion, to allow for full contact between the tuberosities as well as trochanters while alleviating direct pressure on the coccyx, making the traditional doughnut shape pillow take on a more effective shape to alleviate their symptoms.

Another shortcoming associated with the continuous pressure upon the ischia that can be caused by sitting on a circular doughnut-shaped cushion is that the resulting pressure can exacerbate pre-existing orthopedic discomfort. For example, a common condition that often necessitates a specially designed cushion or seating surface is coccygodynia, that is pain resulting from injury to the sacrococcygeal synchrondrosis. A common etiology of this condition is the result of hormonal changes associated with pregnancy that enable the synchondrosis between the sacrum and the coccyx to soften, and unlike fractures, which can remodel, injuries to this region can result in this synchondrosis being repeatedly forced out of its normal position, causing inflammation of the tissues surrounding the coccyx. Management of this condition includes having the patient sit on the usual air-filled doughnut-shaped cushion, however due to the shortcomings associated with the doughnut shape pillow discussed above, many of these patients are forced to either manipulate the shape of the pillow in order to create a comfortable sitting surface or forego the necessary padded seating surface.

Even more common for the general user is the pain and stress associated with driving long distance, as can be experienced by truck, bus or cab drivers. Commonly, individuals who must sit for extended periods while driving long distances often rely on a pillow or cushion not specifically configured for the alleviation of back or other discomfort while sitting in a vehicle. Typical cushioning apparatuses designed to alleviate stress or the discomfort associated with driving consist of seating devices configured as seating pads that are placed between the user and the seat for additional padding, as exemplified in U.S. Pat. No. 3,940,183 to Seltzer et al. However, as with the doughnut-shaped cushion, these devices often slip and become uncomfortable or hazardous for an individual while driving a vehicle. As with individuals who need to manipulate the shape of a cushion to obtain maximal comfort, driving necessitates a secure form of seating to avoid the seat manipulation that can be distracting and unsafe while driving. Even more specifically, the seat cushions that are configured for use for specific therapeutic conditions are generally designed to be used either at home, in an office or in a hospital setting, and are not designed for the wear and tear of everyday use as is experienced by individuals needing such a cushion for driving a vehicle. Seat cushions that are designed to ease back pain while driving, or seating cushions for the palliative support of the lumbar and related areas, are not usually configured to ensure that the sacrum and coccyx areas remain contact free for all users, particularly those with limited hip rotation, and provides no means for direct support of the lower back.

What is needed, therefore, is a cushion in a shape that provides sufficient padding to eliminate pressure upon the ischia of a user. Such a seat cushion should provide the increased advantage of providing heat or cooling to the perineum and ischial areas of the human body. The preferred cushion should be provided in a generally U-shaped configuration in order to conform to the anatomical areas of the human body that require support and padding. The preferred U-shaped cushion should have components which allow it to be secured to the seating surface, thereby providing a secure foundation wherein the cushion does not slip or shift with the movement of the user. The preferred U-shaped cushion should contain the option of directing heat or cold, as needed, to the portion of the human body near or in contact with the cushion. The preferred seat cushion should be constructed such that it is both durable and easily cleaned allowing it to be used in a wide variety of situations.

SUMMARY OF THE INVENTION

The U-shaped seat cushion having thermal transfer unit of the present invention solves the problems and provides the benefits identified above. That is, the U-shaped seat cushion of the present invention has a main body member that is in a generally U-shaped configuration so as to correspond to the anatomical needs of a user, thus providing specific support and padding to eliminate pressure upon the user's ischia. The U-shaped cushion of the present invention has the increased advantage of selectively providing heat or cooling to the perineum and ischial portions of the human body. The U-shape configuration of the seat cushion of the present invention is further enhanced by ring members and strapping that allows the user to secure the seat cushion to a surface on which it is placed so as to create a sitting surface that is stable and does not shift, eliminating the need for frequently repositioning the cushion. In addition, the U-shaped cushion of the present invention is also configured to have a cover that is both durable and easily cleaned, allowing the U-shaped cushion to be used in a wide variety of situations.

In one general aspect, the U-shaped seat cushion of the present invention has a substantially U-shaped body member having a main section at its front end and a pair of arms extending rearwardly from the main section towards the back end of the seat cushion. The body member has a top surface on which the user sits and a bottom surface which is placed on top of a seat, such as a vehicle seat, chair or bench. The pair of rearwardly extending arms define an inner section having a first inner side wall and a second inner side wall, which further define a thermal transfer chamber. Both arms have outer, laterally extending side walls. A thermal transfer unit, which can comprise a thermal unit disposed in a thermal container, such as a pouch or pouch-like device, is placed in the thermal transfer chamber to selectively provide heat or cold to the perineum and ischial portions of the user's body. In one configuration of the present invention, the thermal transfer unit attaches to a lower chamber member that removably attaches to the inner side wall of at least one of the pair of arms. In the preferred embodiment, the lower chamber member attaches to the pair of arms at the bottom surface of the body member. In an alternative embodiment, the lower chamber member attaches to the outer wall of each of the pair of arms. In yet another alternative embodiment, an upper thermal member covers the inner section to further define the thermal transfer chamber. A chamber flap can be used to close the open second end of the thermal transfer chamber.

Another aspect of the present invention is a mechanism for securing the seat cushion to the surface on which the cushion is placed so as to form a stable seating surface. To achieve the desired stability, the outer side surface of at least one of the U-shaped body member arms has a ring member or other type of strap connector which releaseably attaches to a strap to secure the cushion to the seating surface on which it is placed. In one configuration, the outer side surface of each arm has at least one strap connector, such as a D-ring, through which the straps can be threaded or connected. In a preferred embodiment, the U-shaped seating cushion of the present invention is specifically configured to be comfortable, durable and easily cleaned. In one configuration of the present invention, the U-shaped seat cushion has a removable cover made from a fabric that is breathable for comfort, as well as machine washable to increase the versatility of the present seat cushion as a seating surface that can be used in a wide variety of settings, including vehicle seats, chairs, stools and benches.

Accordingly, the primary objective of the present invention is to provide a U-shaped seat cushion having thermal transfer unit that provides the advantages discussed above and overcomes the disadvantages and limitations associated with presently available seat cushions. An important aspect of the present invention is to provide a U-shaped seat cushion that is configured to removably receive a thermal unit adapted to provide heat or cold as needed by the user. It is also an important objective of the U-shaped seat cushion of the present invention to provide a substantially U-shaped body member having a main section and a pair of rearwardly extending arms that define a thermal transfer chamber in which is removably disposed a thermal transfer unit having a thermal unit to provide heat and cold to the user's body. It is also an objective of the present invention to provide a comfortable, versatile and durable seating surface that can be used in a wide variety of seating situations, including driving a vehicle over long distances. Another important objective of the present invention is to provide a secure and stable seating surface that does not shift under the weight of the user on the seating surface on which it is placed. It is also an important object of the present invention to provide a U-shaped seat cushion that is durable and easily cleaned.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures and drawings are merely illustrative of a preferred embodiment and represents one of several different ways of configuring the present invention. Although specific components, materials, configurations and uses are illustrated, it should be understood that a number of variations to the components and to the configuration of those components described herein and in the accompanying figures can be made without changing the scope and function of the invention set forth herein. For purposes of this disclosure, references are generally to use of the present invention as a seating device utilized with vehicle seats, however, it is understood that the disclosure herein will apply to other types of seating devices as well.

Figure 1:
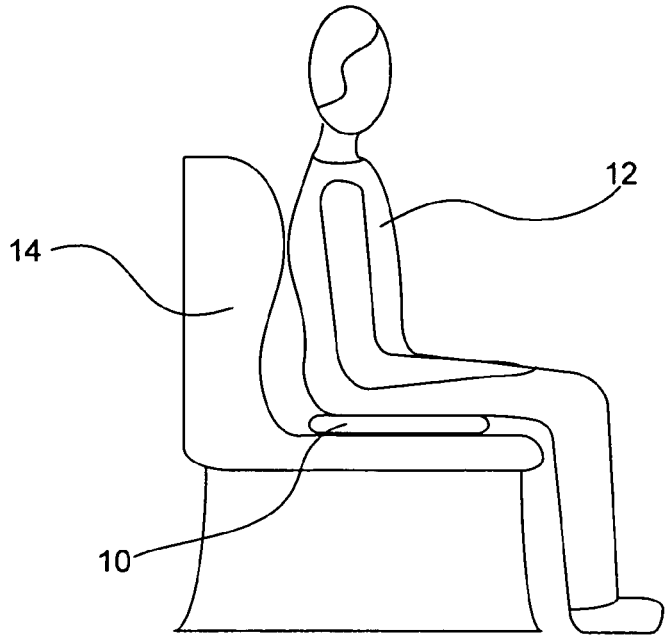
FIG. 1 is a side view of a user sitting on seat cushion configured according to the present invention placed on a seat.
Figure 2:
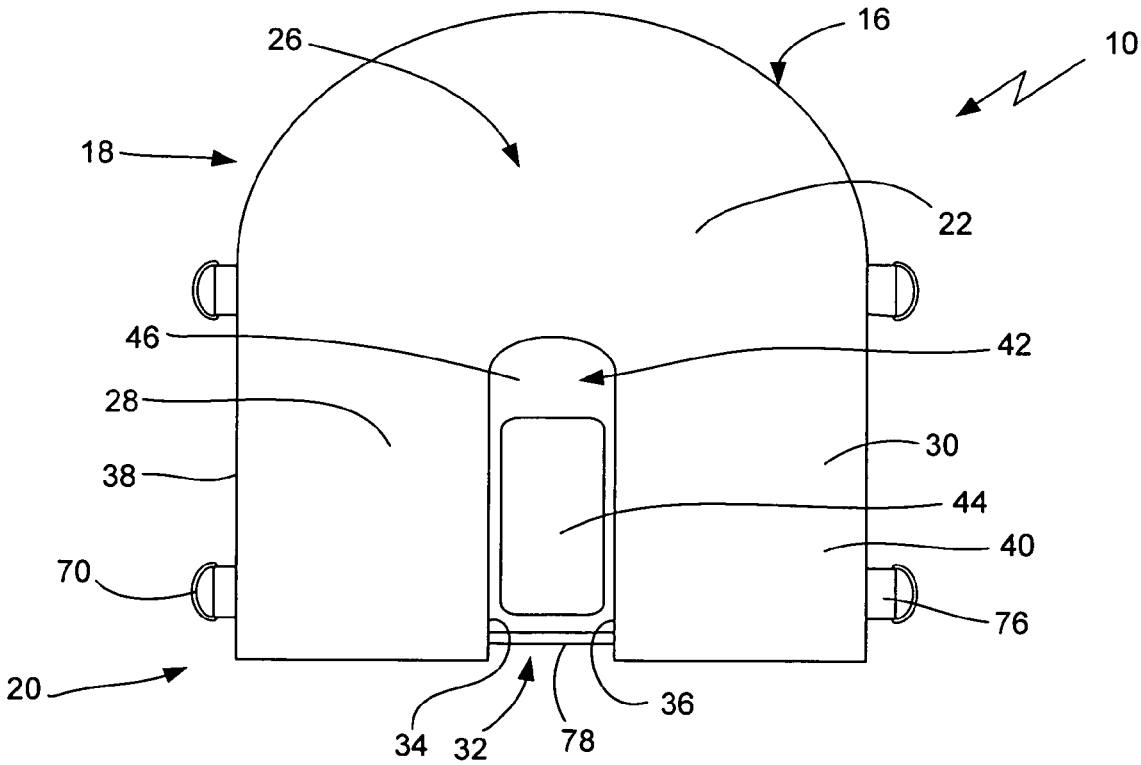
FIG. 2 a top view of a U-shaped seat cushion configured according to the principles and concepts of a preferred embodiment of the present invention.
Figure 3:
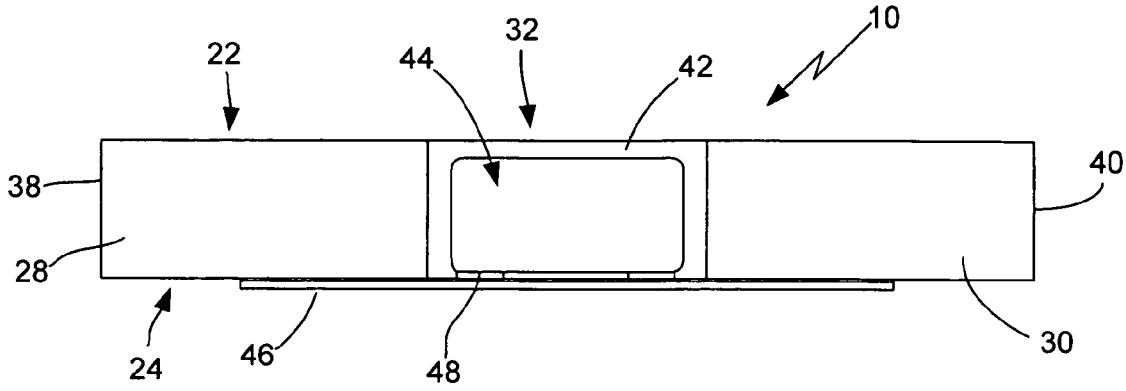
FIG. 3 is a back end view of the U-shaped seat cushion of FIG. 2 showing a lower chamber member attached to the bottom surface of the arms.
Figure 4:
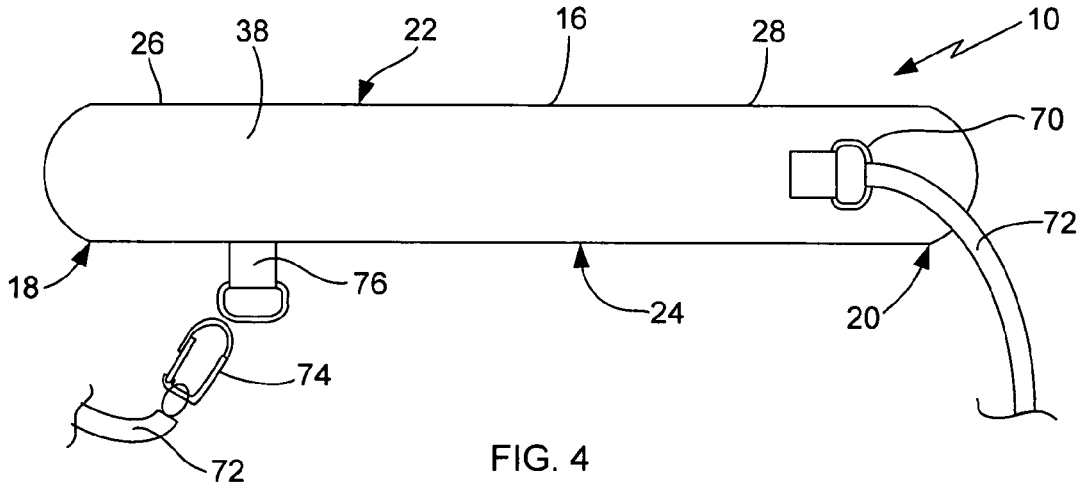
FIG. 4 is a side view of the U-shaped seat cushion of FIG. 2 showing one strap member attached to a ring member and another strap member having a connector for releasably attaching to another ring member.

In the preferred embodiments of the U-shaped seat cushion having thermal transfer unit that is manufactured out of the components and configured pursuant to a preferred embodiment of the present invention is shown generally as 10 in FIGS. 1 through 4. As shown in FIG. 1, seat cushion 10 of the present invention is configured as a cushion that is sized and configured to be disposed between the user 12 and a seat 14, such as a vehicle seat, chair or other types of seating devices, to provide comfort and improved seating to user 12. As best shown in FIGS. 2 and 4, seat cushion 10 comprises a generally U-shaped body member 16, having front end 18, back end 20, top surface 22 and bottom surface 24, that is better suited to the human body anatomy than presently available seat cushions. Specifically, seat cushion 10 provides for full contact of the tuberosities and trochanters areas of the human body and top surface 22 of body member 16 while alleviating direct pressure on the coccyx while the user 12 is sitting on seat cushion 10. As shown in FIG. 2, a generally curved-shaped main section 26 of body member 16 defines the front end 18 of seating cushion 10 and a pair of arms, shown as first arm 28 and second arm 30, extend rearwardly from main section 26 to define back end 20 of seating cushion 10. In the preferred embodiment, first 28 and second 30 arms are generally parallel and in spaced apart relation to each other so as to define an inner section 32 therebetween that extends from the back side of main section 26 to back end 20. As best shown in FIGS. 2 and 3, first arm 28 has a first inner side wall 34 and second arm 30 has a second inner side wall 36, which define the sides of inner section 32, and a first outer side wall 38 and second outer side wall 40 that define the outer surfaces of seating cushion 10.

As well known to those skilled in the art of seat cushions and seats generally, seat cushion 10 should be made out of materials that are comfortable for user 12 to sit on and which will be sufficiently durable and stain resistant to be useable for its intended purpose as a cushioning and support device between user 12 and seat 14. In one embodiment, U-shaped body member 16 comprises a cushion element (not shown) that is made out of foam or other comfortable cushion-like material, and a more durable, but user contact friendly material, such a denim, flannel, cotton, leather or the like, cover (also not shown) that is disposed around the cushion element. As well known, the outer cover can be configured to be fixedly attached to or joined with the inner cushion element or it can be configured as a removable cover, by providing a connector such as a zipper, buttons, snaps, Velcro® or the like, to allow user 12 to be able to remove the cover for cleaning or replacement with another cover when it becomes worn or for purposes of aesthetic changes. In another embodiment, body member 16 is made out of material that provides the features of both the cushion element and the cover (i.e., not separate components). In either embodiment, it is preferred that the materials be washable. The materials for seat cushion 10 can be of a virtually unlimited color, designs or other configurations that appeal to user 12.

For comfort of the user 12, body member 16 should be sized and configured to comfortable support user 12 when he or she is sitting on seat cushion 10 on seat 14. As will be readily apparent to those skilled in the art, it is important that body member 16 avoid being too thick or having arms 28 and 30 that are so long that main section 26 extends beyond the forward edge of seat 14. In one configuration, presented merely as an example configuration and not intended to limit seat cushion 10 of the present invention, body member 16 can be approximately sixteen to eighteen inches wide by sixteen to eighteen inches deep (i.e., front end 18 to back end 20), having arms 28 and 30 approximately seven inches wide and the width of inner section 32 being approximately three to three and one-half inches wide. Body member 16 can be one to three inches thick, with two inches being preferred, depending on the desired cushion support and the materials utilized to provide the cushion element.

In the preferred embodiment of seat cushion 10, inner section 32 defines a thermal transfer chamber 42 in which is disposed thermal transfer unit 44, as best shown in FIGS. 2 and 3. In the preferred embodiment, thermal transfer chamber 42 is further defined by one or more chamber members, such as lower chamber member 46 that interconnects first 28 and second 30 arms at or near the bottom surface 24 of body member 16, as best shown in FIG. 3. In the embodiment shown in FIG. 3, thermal transfer chamber 42 is open at back end 20 and along top surface 22. To secure thermal transfer unit 44 in place, the preferred embodiment of seat cushion 10 comprises one or more unit attachment mechanisms, shown as 48, that interconnects thermal transfer unit 44 and lower chamber member 46. In one embodiment, unit attachment mechanism 48 comprises appropriately configured strips of Velcro®. As well known by those skilled in the art, unit attachment mechanism 48 can be snaps, buttons or other securing devices. In yet another configuration, attachment mechanism 48 can merely comprise the difference between the materials utilized for thermal transfer unit 44 and lower chamber member 46 such that thermal transfer unit 44 is frictionally held in place (or at least prohibited from easily sliding out thermal transfer chamber 42).

Figure 6:
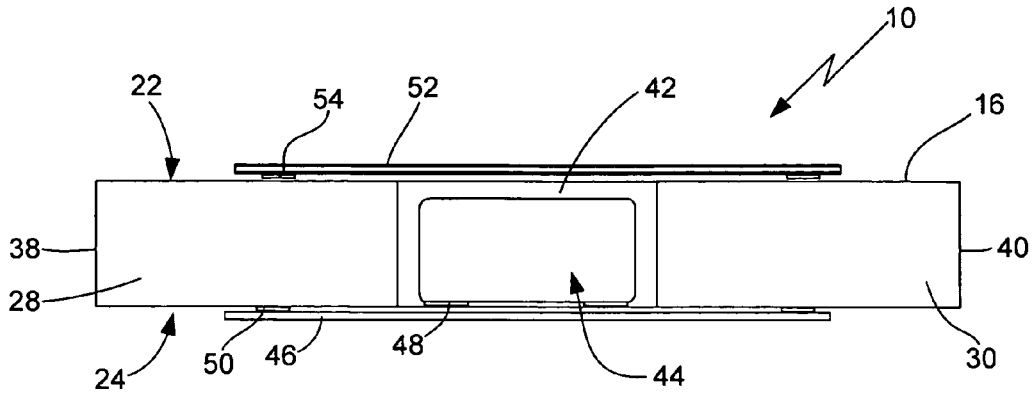
FIG. 6 is a back end view of an alternative embodiment of the U-shaped seat cushion showing use of an upper chamber member and a lower chamber member removably attached to the arms.
Figure 7:
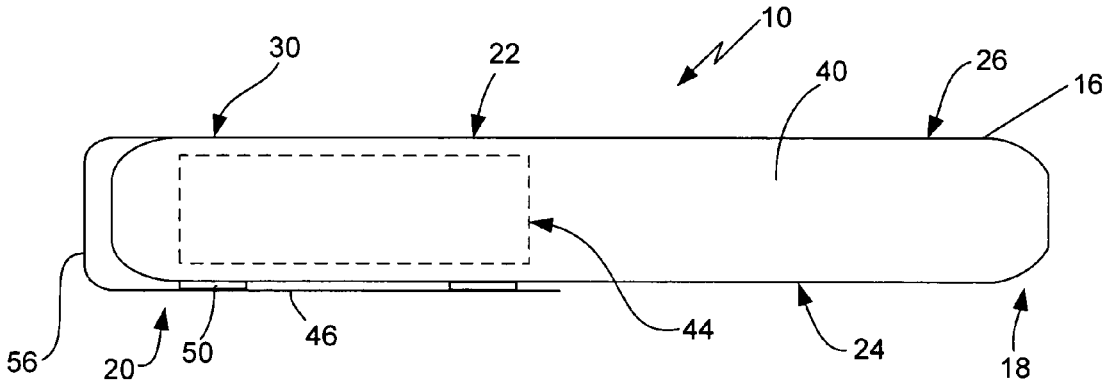
FIG. 7 is a side view of an alternative embodiment of the U-shaped seat cushion showing a chamber flap member covering the back end.
Figure 8:
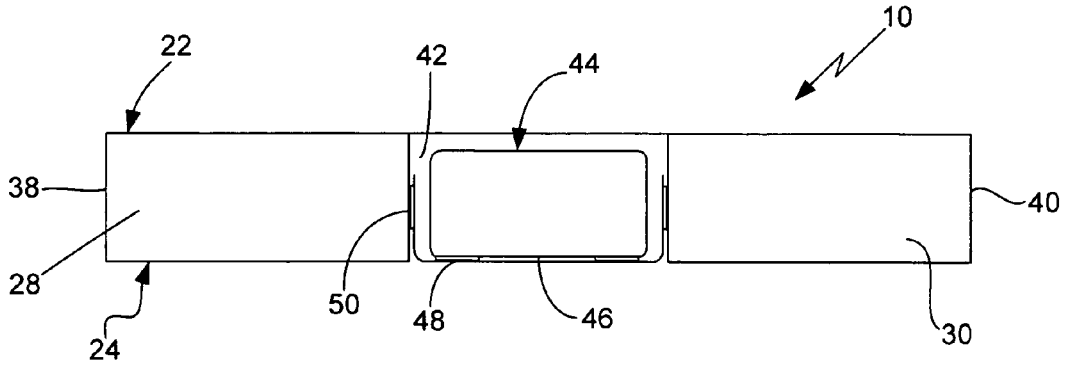
FIG. 8 is a back end view showing an alternative embodiment of the U-shaped seat cushion showing the lower chamber member attached to the inner side walls of the arms.

In the embodiment shown in FIG. 3, lower chamber member 46 is fixedly secured to the bottom surface 24 of first 28 and second 30 arms across the width and depth of inner section 32. The lower chamber member 46 can be sewn to the bottom surface 24 of arms 28 and 30 or it can be made integral therewith. In the embodiment shown in FIG. 6, lower chamber member 46 removably attaches to the bottom surface of arms 28 and 30 by use of one or more first connecting mechanisms 50. In a preferred embodiment, first connecting mechanism 50 is Velcro®, although snaps, buttons, zippers and other connecting devices can also be utilized for first connecting mechanism 50. In the embodiment shown in FIG. 8, lower chamber member 46 releasably attaches to first 34 and second 36 inner walls of first 28 and second 30 arms, respectively, utilizing one or more first connecting mechanisms 50 (as described above). As will be understood by those skilled in the art, lower chamber member 46 can alternatively attach, fixedly or removably, to the first 38 and second 40 outer walls of first 28 and second 30 arms of body member 16. As also shown in the embodiment of FIG. 6, thermal transfer chamber 42 can be further defined by upper chamber member 52 that is disposed across the open upper area of inner section 32 to define the top wall of thermal transfer chamber 42. As with lower chamber member 46, upper chamber member 52 can be fixedly attached to or integral with upper surface 22 of first 28 and second 30 arms or it can removably attach thereto using one or more second connecting mechanisms 54, as shown in FIG. 6. In the embodiment shown in FIG. 7, the back end 20 of body member 16 is provided with a chamber flap member 56 that is configured to close thermal transfer chamber 42 at the back end 20 of inner section 32 by folding over arms 28 and 30 at back end 20. In FIG. 7, chamber flap member 56 also forms lower chamber member 46 and is secured to the bottom surface 24 of first 28 and second 30 arms, as described above. In this embodiment, it may not be necessary to utilize the one or more attachment mechanisms 48, as chamber flap member 56 can be configured to sufficiently secure thermal transfer unit 44 in thermal transfer chamber 42.

Figure 5:
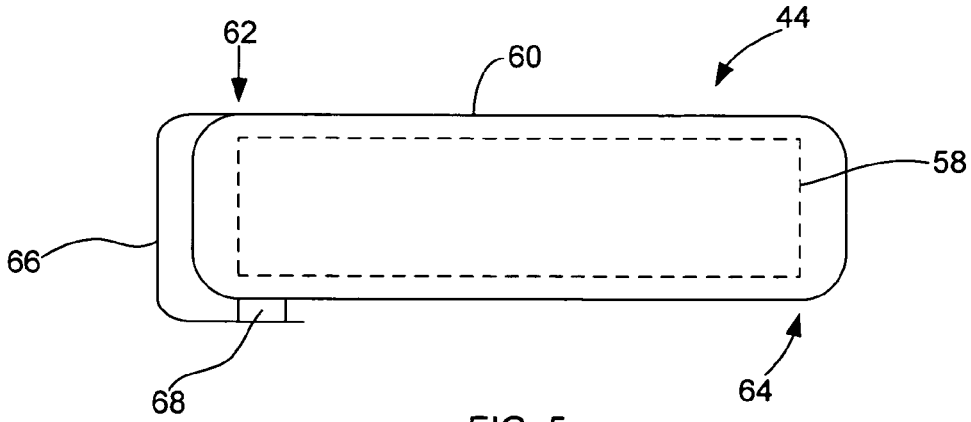
FIG. 5 is an isolated side view of the thermal transfer unit shown in FIGS. 2 and 3.

In a preferred embodiment, as shown in FIG. 5, thermal transfer unit 44 comprises thermal unit 58 disposed inside thermal container 60, having a open first end 62 and a closed second end 64. Preferably, thermal container 60 has a closure flap 66 at the first end 62 to close thermal unit 58 inside thermal container 60. If desired, a closure mechanism 68 can be provided to releasably close closure flap 66. In a preferred embodiment, closure mechanism 68 can be Velcro®, snaps, buttons or other closure devices or it can comprise a loop on the bottom of thermal container in which a portion of closure flap 66 is received. A preferred configuration for thermal container 60 is a pouch or pouch-like device that is made out of cloth, felt or other material. As explained in more detail below, thermal unit 58 is configured to transmit heat or cold to user 12 when he or she is sitting on seat cushion 10. Use of thermal container 60 and/or upper chamber member 52 helps prevent too much heat or cold contacting user 12 and, potentially, causing more harm than good.

In a preferred embodiment, thermal unit 58 is adaptable to transmit either heat or cold to user 12, as desired by user 12. As readily understood by those familiar with such devices, thermal unit 58 can comprise certain solids, gels or fluid materials or similar substances, or combinations thereof, inside an outer casing that can be subjected, selectively, to heat or cold temperatures and then become hot or cold so as to transmit the heat or cold inside thermal transfer unit 44 and thermal transfer chamber 42. In a preferred embodiment, thermal unit 58 comprises a ceramic-type of material that is capable of holding its temperature longer and will not leak, relative to gel or liquid-based materials. Thermal unit 58 can be placed in the refrigerator or freezer or it can be placed inside a microwave oven or a pot of hot water to provide a source of cold or heat. Preferably, as set forth above, thermal transfer unit 44, comprises thermal unit 58 inside thermal container 60, is placed inside thermal transfer chamber 42. Thermal unit 58 is sized and configured to transmit heat or cold to user 12 as he or she sits on seat cushion 10 of the present invention. Naturally, care has to be taken such that excessive heat or cold is not transmitted to user 12 when he or she is sitting on seat cushion 10 placed on seat 14.

To stabilize seat cushion 10 of the present invention, the preferred embodiment includes one or more ring members 70, such as the D-rings best shown in FIG. 4, on first 38 and second 40 outer walls of body member 16 for attachment to one or more straps 72 used to secure seat cushion 10 to seat 14. Preferably, seat cushion comprises a pair of ring members 70 toward each of front end 18 and back end 20 so that straps 72 can go around the bottom of seat 14 using ring members 70 toward the front end 18 and/or a second set of straps 72 can go around the back of seat 14 using ring members 70 toward the back end 20 to stabilize seat cushion 10 on seat 14. As known to those skilled in the art, straps 72 can fixedly connect to one ring members 70 on one side (i.e., either at first 38 or second 40 outer wall) and removably connect to the ring member 70 on the opposite outer wall. As shown in FIG. 4, straps 72 can releasably connect using a J-hook connector 74 or other suitable ring connector to engage ring member 70. Ring members 70 and straps 72 can be configured to eliminate or substantially reduce the movement of seat cushion 10 when user 12 is sitting on it above seat 14. As those skilled in the art will recognize, the D-rings 70 can be other annularly shaped connectors that attach, directly or indirectly using ring extensions 76 (as shown in FIG. 4), to the outer lateral outer walls 38 and 40 of arms 28 and 30. In an alternative embodiment of the present invention, straps 72 can be configured to fasten with variety of different connectors, such as a slider buckles, Velcro® or quick release snap locks. Straps 72 can be made out of a variety of materials, such as nylon strap material, that are sufficiently strong to hold seat cushion 10 securely in place on seat 14.

The preferred embodiment of the seat cushion 10 of the present invention also includes a strap member 78 that interconnects first arm 28 and second arm 30, as shown in FIG. 2. Strap member 78 is configured to keep arms 28 and 30 from separating due to the weight and movement (i.e., shifting in their seat) of user 12. In a preferred configuration, strap member 78 is approximately one inch wide that is sewn or otherwise attached to the bottom surface 24 of first 28 and second 30 arms at approximately two inches from the back end 20 of seat cushion 10.

In use, user 12 utilizes straps 72 and ring members 70 to secure seat cushion 10 to seat 14 with back end 20 thereof at or facing the back portion of seat 14. Thermal unit 58 is placed in a cold source, such as the refrigerator or freezer, or a hot source, such as the microwave or pot of hot water, to provide a source of cold or heat for the user 12. Once thermal unit 58 is at the desired temperature, then the user 12 removes it and places it in thermal container 60 and attaches it to lower chamber member 46 inside thermal transfer chamber 42 using the one or more unit attaching mechanisms 48. If utilized, upper chamber member 52 is placed over inner section 32 to close the top of thermal transfer chamber 42. The user 12 then sits on seat cushion 10 such that it will provide heat or cold to the seat area of user's body, thereby helping prevent poor circulation, pressure and excessive heat and moisture to the male reproductive organs, perineum and anal areas. In addition, seat cushion 10 will provide comfort for those who suffer from chronic prostatitis or hemorrhoids. Persons who have undergone rectal, hemorrhoidal or prostate surgery, or women who have stitches from childbirth, will benefit from seat cushion 10 of the present invention.

While there are shown and described herein a specific form of the invention, it will be readily apparent to individuals skilled in the art that the invention is not so limited, but is susceptible to, various modifications and rearrangements in design and materials without departing from the spirit and scope of the invention. In particular, it should be noted that the present invention is subject to modification with regard to any dimensional relationships set forth herein and modifications in assembly, materials, size, shape, and use. For instance, there are numerous components described herein that can be replaced with equivalent functioning components to accomplish the objectives of the present invention.

What is claimed is:

1. A seat cushion for use on a seat, comprising:

a substantially U-shaped body member having a front end, a back end, a top surface and a bottom surface, said body member having a main section at said front end and a pair of arms extending rearwardly from said main section, said pair of arms in spaced apart relation and defining an inner section therebetween, said inner section having a first inner side wall on one of said pair of arms and a second inner side wall on the other of said pair of arms, each of said arms having an outer wall;

a thermal transfer chamber defined by said inner section;

a lower chamber member interconnecting said pair of arms;

an upper chamber member interconnecting said pair of arms, said lower chamber member and said upper chamber member further defining said thermal transfer chamber; and a thermal transfer unit disposed in said thermal transfer chamber.

2. The seat cushion according to claim 1, wherein said lower chamber member is removably attached to each of said pair of arms by one or more unit attachment mechanisms.

3. The seat cushion according to claim 1, wherein said lower chamber member is attached to said bottom surface of said body member.

4. The seat cushion according to claim 1, wherein said lower chamber member is attached to at least one of said first inner side wall and said second inner side wall.

5. The seat cushion according to claim 1, wherein said thermal transfer unit is removably attached to said lower chamber member.

6. The seat cushion according to claim 1 further comprising a chamber flap member, said chamber flap member configured to close said thermal transfer chamber at said back end of said body member.

7. The seat cushion according to claim 1 further comprising an upper chamber member interconnecting said pair of arms, said upper chamber member further defining said thermal transfer chamber.

8. The seat cushion according to claim 7 further comprising a chamber flap member, said chamber flap member configured to close said thermal transfer chamber at said back end of said body member.

9. The seat cushion according to claim 1 further comprising one or more ring members on each of said outer wall of said pair of arms, each of said one or more ring members attached to a strap, each of said straps sized and configured to secure said seat cushion to said seat.

10. The seat cushion according to claim 1, wherein said thermal transfer unit comprises a thermal unit adaptable for transmitting heat or cold into said thermal transfer chamber.

11. The seat cushion according to claim 10, wherein said thermal transfer unit is removably disposed in a thermal container.

12. A seat cushion for use on a seat, comprising:

a substantially U-shaped body member having a front end, a back end, a top surface and a bottom surface, said body member having a main section at said front end and a pair of arms extending rearwardly from said main section, said pair of arms in spaced apart relation and defining an inner section therebetween, said inner section having a first inner side wall on one of said pair of arms and a second inner side wall on the other of said pair of arms, each of said arms having an outer wall;

a lower chamber member interconnecting said pair of arms, said lower chamber member is removably attached to each of said pair of arms by one or more unit attachment mechanisms;

a thermal transfer chamber defined by said inner section and said lower chamber member; and a thermal transfer unit disposed in said thermal transfer chamber, said thermal transfer unit comprising a thermal unit adaptable for transmitting heat or cold into said thermal transfer chamber.

13. The seat cushion according to claim 12 further comprising an upper chamber member interconnecting said pair of arms, said upper chamber member further defining said thermal transfer chamber.

14. The seat cushion according to claim 13 further comprising a chamber flap member, said chamber flap member configured to close said thermal transfer chamber at said back end of said body member.

15. The seat cushion according to claim 1 further comprising one or more ring members on each of said outer wall of said pair of arms, each of said one or more ring members attached to a strap, each of said straps sized and configured to secure said seat cushion to said seat.

16. A seat cushion for use on a seat, comprising:

a substantially U-shaped body member having a front end, a back end, a top surface and a bottom surface, said body member having a main section at said front end and a pair of arms extending rearwardly from said main section, said pair of arms in spaced apart relation and defining an inner section therebetween, said inner section having a first inner side wall on one of said pair of arms and a second inner side wall on the other of said pair of arms, each of said arms having an outer wall;

a lower chamber member interconnecting said pair of arms;

an upper chamber member interconnecting said pair of arms;

a thermal transfer chamber defined by said inner section, said upper chamber member and said lower chamber member;

a chamber flap member, said chamber flap member configured to close said thermal transfer chamber at said second end of said body member; and a thermal transfer unit disposed in said thermal transfer chamber, said thermal transfer unit comprising a thermal unit adaptable for transmitting heat or cold into said thermal transfer chamber, said thermal unit disposed in a thermal container.

* * * * *